US005685484A

United States Patent [19]

Dehnad

[11] Patent Number: 5,685,484

[45] Date of Patent: Nov. 11, 1997

[54] PRESSURIZED WATER TOY HAVING A PRESSURE ACTUATED PULSATOR

[76] Inventor: Houdin Dehnad, 435 Miramontes Ave., Half Moon Bay, Calif. 94019

[21] Appl. No.: 564,405

[22] Filed: Nov. 29, 1995

[51] Int. Cl.[6] ..... B05B 1/08

[52] U.S. Cl. ..... 239/99; 239/101; 239/211; 239/570; 137/474; 137/624.14; 417/542; 446/34; 446/435

[58] Field of Search ..... 239/97, 99, 101, 239/211, 381, 533.13, 570; 222/491, 494–6; 244/136; 137/469, 474, 624.14; 446/34, 435; 417/540, 542

[56] References Cited

U.S. PATENT DOCUMENTS

| | | | |
|---|---|---|---|
| 2,921,743 | 1/1960 | Westover et al. | 239/240 |
| 3,902,664 | 9/1975 | Deines | 239/102 |
| 4,512,514 | 4/1985 | Elcott | 239/99 |
| 4,757,946 | 7/1988 | Johnson | 239/99 |
| 4,781,217 | 11/1988 | Rosenberg | 137/624.14 |
| 4,889,154 | 12/1989 | Rosenberg | 137/474 |
| 4,909,441 | 3/1990 | Christy | 239/109 |
| 4,949,747 | 8/1990 | Rosenberg | 137/107 |
| 5,144,980 | 9/1992 | Rosenberg | 137/624.14 |
| 5,314,116 | 5/1994 | Krauth et al. | 239/99 |
| 5,370,317 | 12/1994 | Weston | 239/533.14 |
| 5,370,318 | 12/1994 | Weston | 239/533.14 |
| 5,447,258 | 9/1995 | Suzuki | 222/494 |

*Primary Examiner*—Andres Kashnikow
*Assistant Examiner*—Lisa Ann Douglas
*Attorney, Agent, or Firm*—Janet Peyton Schafer

[57] ABSTRACT

A pressurized water toy providing a pressure actuated pulsator for shooting water in consecutive pulses. The pressure actuated pulsator includes expansible inlet and outlet tubing, a reservoir for the temporary retention of water, and a sphere-shaped obturator for temporarily blocking the flow of water through the outlet tubing. Flow of pressurized water into the expansible tubing expands and elongates the tubing and forces a seal to be formed by biasing the sphere-shaped obturator against a first end of the outlet tubing compressing a spring. A buildup of pressure behind the obturator causes the expansible tubing to expand and permit passage of the pressurized water around the obturator and into and through the nozzle. When the pressure behind the obturator drops below a certain level, the obturator again blocks the orifice into the outlet tubing causing a buildup of pressure there behind and the cycling of pulse of water flow continues.

20 Claims, 3 Drawing Sheets

PRESSURIZED WATER TOY HAVING A PRESSURE ACTUATED PULSATOR

BACKGROUND

This invention relates to the field of amusement devices and more particularly to the field of pressurized water toys having a pressure actuated pulsator.

Amusement devices and toys have shown increased popularity when they closely resemble the actual device. For example, to represent a machine gun firing, a water gun must eject water in a pulsatory manner. Previously this pulsatory manner has been achieved by utilizing an electrical or mechanical pulsator. A previous electrical pulsator requires electronic circuits, pumps and power sources which complicate the apparatus and increase the cost of manufacture and repairing that they require precisely manufactured mechanical components having numerous parts. Additionally, the previous pulsators have been bulky in size and not adaptable to small scale toys. Also, most prior electrical and mechanical pulsators would not operate effectively if inverted. A further problem has been that upon consecutive "firings", the pulses decrease in rate as result of decreasing pressure in the chamber.

For the foregoing reasons, there is a need for an economical pulsator that controls the flow of pressurized water from a source, and can be adapted to a toy water gun, to produce consecutive rapid sequence water pulses, even when the toy is inverted.

SUMMARY

The present invention is directed to a device that satisfies these needs for an economical pulsator that controls the flow of pressurized water and is adaptable to a toy water gun, to produce consecutive rapid sequence fluid pulses, even when inverted. A device having features of the present invention comprises a fluid pulsator apparatus having a fluid inlet and outlet, means for supplying fluid to the pulsator, an expansible tubing for receiving the fluid, the expansible tubing expanding in response to increased fluid pressure, an obturator retained within the expansible tubing for releasably blocking the pulsator outlet providing means for temporarily restricting flow through a nozzle allowing for a buildup of pressure for powering the toy, and means for actuating release of fluid in a pulsating stream through the pulsator.

A fluid pulsation apparatus having means for actuating release of fluid through the pulsator having a trigger button which, when manually depressed, actuates the pulsator, temporarily releasing the flow allowing a release of fluid in a pulsating stream through the pulsator.

A fluid pulsation apparatus having a fluid inlet and outlet, having a generally elongated expansible reservoir, mounted in fluid in communication with the fluid inlet, a length of expansible elastomeric tubing, mounted adjacent reservoir and a nozzle, mounted on an end of the length of expansible elastomeric tubing for imparting directional flow to fluid exiting fluid outlet.

A toy having fluid inlet and outlet means, an expansible reservoir for receiving fluid, a nozzle for imparting directional flow to fluid exiting fluid toy, flexible tubing for fluid communication of reservoir and nozzle, an obturator that while in a blocking position, temporarily blocks fluid flow through expansible tubing to nozzle, means for moving obturator to a blocking position, blocking fluid flow through both the expansible tubing and housing, and means for moving obturator to an unblocking position where obturator blocks neither the expansible tubing nor the housing allowing fluid flow from expansible tubing to the nozzle, means for moving the obturator back to its blocking position, and means for alternating obturator from a blocking position, to an unblocking position alternatingly blocking fluid flow and allowing fluid flow through the nozzle thus providing a pulsating stream through the nozzle.

In a fluid pulsator having means for moving obturator to an unblocking position further comprises increasing fluid pressure within the expansible tubing by increasing the amount of fluid inside the expansible tubing in response to manually pushing the trigger button allowing fluid to flow from the reservoir into the expansible tubing, expanding the tubing allowing fluid to bypass the obturator relieving pressure on the obturator and allowing a compression spring, mounted within the housing, to press upon the obturator forcing the obturator in a relatively backwards motion into the expansible tubing allowing the fluid to enter the nozzle and exit the device. Release of fluid from the pulsator through the nozzle reduces the fluid pressure within the expansible tubing forcing obturator back to the blocking position blocking fluid flow through the outlet. Repetition of this fluid pressure build up, biasing obturator away from the outlet opening allowing exit of fluid reducing fluid pressure within expansible tubing and biasing obturator back to the blocking position, gives a pulsating action to the fluid stream.

In a fluid pulsator having means for moving obturator back to its blocking position further includes reducing the fluid pressure within the expansible tubing, as a result of fluid exiting the expansible tubing through the nozzle, which allows the tubing to retract, the fluid pressure pushing the obturator back to its blocking position, blocking outlet of the fluid into the nozzle.

A second embodiment provides a fluid pulsator having a nozzle with at least one aperture formed in a first end thereof for water flow therethrough, build up of fluid pressure in response to increased amounts of fluid within expandable tubing expands expandable tubing reducing the relatively forward pressure on obturator releasing a tension spring that biases obturator inwardly unsealing outlet and allowing fluid to flow through the outlet. Release of fluid through the outlet reduces the fluid pressure within the expansible tubing allowing obturator to return to a blocking position blocking the expansible tubing. The alternating blocking and unblocking by the obturator of the expansible tubing provides the pulsating stream.

It is an object of the present invention to provide a pulsator for use as a pressurized water toy that is simple to manufacture due to fewer, less complicated components. Additionally it is an object of the present invention to provide a pulsator in a pressurized water toy adaptable to small toys, and capable of fitting several pulsators onto a single toy. Further it is an object of this invention to provide a pulsator in a water gun capable of firing even when the gun is inverted, and continues firing with a rapid fire rate until the reservoir is emptied. Additionally, it is an object of the invention to provide ease of filling the reservoir when empty or when partially empty.

BRIEF DESCRIPTION OF THE DRAWINGS

Understanding of the invention will be enhanced by referring to the accompanying drawing, in which like numbers refer to like parts in the several views and in which:

FIG. 3*b'* is a sectional view of the device taken along lines 3—3 of FIG. 1, with the obturator blocking the outlet port and compressing the spring and the expansible chamber expanded;

DETAILED DESCRIPTION OF THE PREFERRED EMBODIMENTS

Understanding of the invention will be further enhanced by referring to the following illustrative but nonlimiting example.

Definitions

Jet: A jet has an input opening larger than that of the output opening thereby creating additional force in the outgoing fluid, air, or the like, passing there-through.

Expansible: Capable of being expanded.

Obturator: An obstruction or closing.

Pulsator: Something that beats or throbs in working.

Overview

Figure 1:
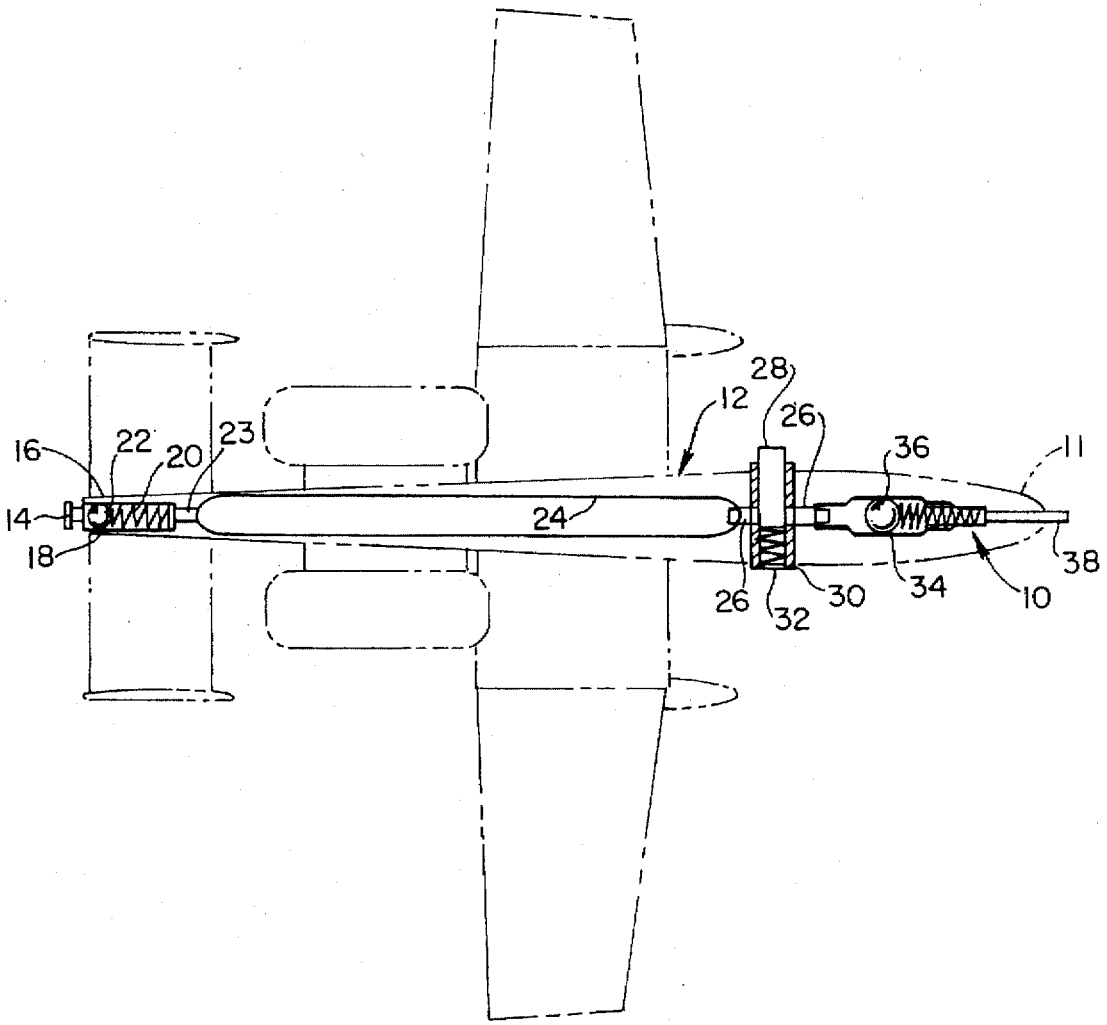
FIG. 1 is a top plan view of a toy adapted with the pulsator of this invention.

FIG. 1 shows a water gun, for descriptive purposes, a scale model A-10 "Warthog" jet fighter is shown although other shooting toys could be adapted for use with the pulsator 10 of this invention. Reservoir 24 receives fluid through loading port 14 and stores a fluid, ex. water, for use with pulsator 10. Pulsator 10, shown in detail at FIGS. 3*a*–3*c*, has expansible tubing 34 mounted adjacent reservoir 24. Retained within expansible tubing 34, is obturator 36, which, while in its first position illustrated at FIG. 3*a*, temporarily blocks fluid flow out of the expansible tubing 34 by forming a fluid seal with the expansible tubing 34. When obturator 36 is biased to a second position, illustrated at FIG. 3*b*, obturator 36 blocks both the expansible tubing 34 and the first end of housing 43 are blocked preventing fluid flow through outlet port, nozzle 38. FIG.3*c* illustrates obturator 36 in a third position, where neither expansible tubing 34 nor first end of housing 43 are blocked allowing fluid to flow out of the expansible tubing 34 and into and through the outlet port, nozzle 38. Fluid flows out of the pulsator 10 through nozzle 38 in response to manual actuation of a trigger or button 28 by the user. Continued depressing of actuation button 28 by user results in the fluid flowing through outlet, nozzle 38, in consecutive pulses. Additionally, nozzle 38, supported by nose end 11 of toy housing 12, imparts directional flow to the fluid flow as it exits the toy.

DETAILED DESCRIPTION

Figure 2:
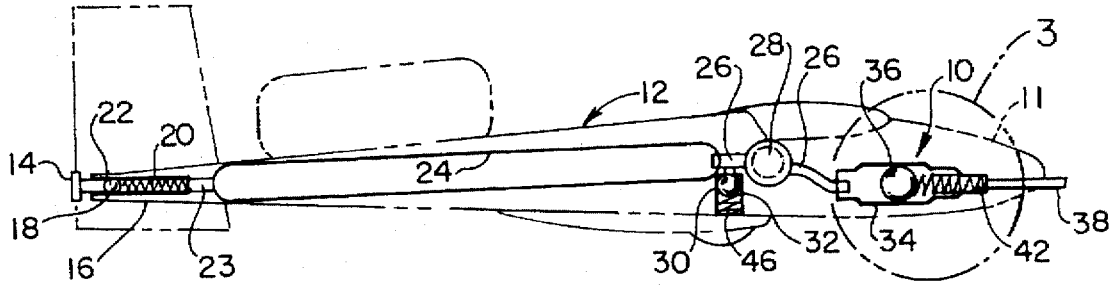
FIG. 2 is a side plan view of the embodiment of FIG. 1 with parts removed for ease of understanding.

Shown at FIG. 1 & 2, pulsator 10 is located generally in the nose end 11 of the jet fighter toy 12. Loading port 14 is shown at the tail end 16 of the jet fighter 12. Fluid enters the apparatus at loading port 14 having a generally tubular rigid housing. A check valve 18 prevents back-flow of the fluid out loading port 14. Check valve 18 has positioned internally thereof compression spring 20 which biases barrier 22 against loading port 14 preventing back-flow. Compression spring 20 is overcome during loading of fluid into loading port 14 by fluid pressure compression of spring 20.

Connecting conduit 23, elongated in shape and of flexible materials, allows fluid flow communication between loading port 14 and reservoir 24 allowing passage of fluid into reservoir 24 when spring 20 is overcome. In actual use conditions, latex tubing has been used as connecting conduit 23, although other flexible materials could be used. Connecting conduit 26, generally tubular in shape and of flexible materials, allows fluid flow communication between reservoir 24 and expansible tubing 34, a hollow chamber, in actual use conditions of latex rubber although other elastomeric materials could be used, for receiving fluid flow from reservoir 24. Manually depressing by the user of actuation button 28 releases pressure valve 30 permitting fluid flow through connecting conduit 26 into expansible tubing 34. In its normal resting position, actuation button 28, positioned within housing surrounding pressure valve 30, is biased outwardly, by means of pressure spring 32 also positioned within pressure valve 30 with pressure valve 30 blocking fluid flow communication between reservoir 24 and expansible tubing 34. Activation of actuation button 28 overcomes spring biasing means of pressure spring 32 and urges pressure valve 30 to open, unblocked position permitting fluid flow communication between reservoir 24 and expansible tubing 34. Fluid held in expansible tubing 34 ultimately flows through outlet tubing, nozzle 38.

Held internally of expansible tubing 34 is sphere-shaped obturator 36, in actual use conditions of stainless steel materials although other resilient materials such as other metals, plastic, ceramic could be used. Obturator 36, shown in detail in FIGS. 3*a*–3*d*, provides means, while in its first position, FIG. 3*a*, for temporarily blocking a first end of expansible tubing 40 preventing fluid flow through pulsator 10. Biasing obturator 36 to a second position, FIG. 3*b*, temporarily blocks both expansible tubing 34 and a first end of housing 43 blocking fluid flow through pulsator 10. FIG. 3*c* illustrates obturator 3*e* biased to a third position where neither expansible tubing 34 nor first end of housing 43 are blocked permitting fluid flow through pulsator 10 and out outlet, nozzle 38.

Continued activation of actuation button 28 results in obturator 36 being urged to first, second and third positions a number of times, alternatingly blocking and unblocking the fluid flow passage through nozzle 38, providing the pulsating action of the fluid flow. Continued activation of actuation button results in obturator 36 continuing to alternate between first, second and third positions, providing the pulsating action of the fluid flow, until reservoir 24 is emptied.

Obturator 36 is at rest in a first position, FIG. retained within expansible tubing 34 and in contact with an inner edge 33 of expansible tubing 34, blocking expansible tubing Fluid flow into expansible tubing 34, in response to actuation of activation button 28, permits fluid flow into expansible tubing 34 from reservoir 24, the more fluid flowing into expansible tubing 43, the higher the fluid pressure. This fluid pressure exerts force on obturator 36 biasing obturator 36 to a second position, FIG. 3*b* blocking both expansible tubing 34 and a first end of housing 43. Compression spring 42, retained within housing 44 in the first embodiment, is mounted adjacent first end of expansible tubing 40. Fluid pressure within expansible tubing 34 urges obturator 36 from a normal first position FIG. 3*a* to a second position, FIG. 3*b* blocking both expansible tubing 34 and first end of housing 43. As fluid pressure within expansible tubing increases, in response to additional fluid flowing into expansible tubing 34, obturator 36 is biased to the second position compressing compression spring 42, FIG. 3*b*. Further increase of fluid pressure within expansible tubing expands expansible tubing 34, once the pressure reaches a predetermined level, allowing fluid flow to bypass obturator 34, indicated by arrows at FIG. 3*b'*, and act in conjunction with compression spring 42 to urge obturator 34 to a third position, FIG. 3*c* unblocking both expansible tubing 34 and first end of housing 43 permitting fluid to flow through pulsator 10 and exit outlet, nozzle 38.

Housing 44, in actual use conditions, is of hard plastic although other resilient materials such as ceramic or metal could be used, at a first end 43 houses compression spring 42. Second end of housing 45 forms nozzle 38. Housing 44 is received by the first end of expansible tubing 40 and forms a seal with obturator 36 at first end of housing 43 when obturator 36 is in its second position FIG. 3*b*. Expansible tubing 34 receives housing 44 by being manually stretched over first end of housing 43. Barbs 61 are formed in the first end of housing 43 to aid retention of housing 44 by expansible tubing 34. Expansible tubing 34, of elastomeric material, adapts to receive barbs 61 and resists release of barbs 61 and therefore secures housing 44 to expansible tubing 34.

How Invention is Used

Figure 3A:
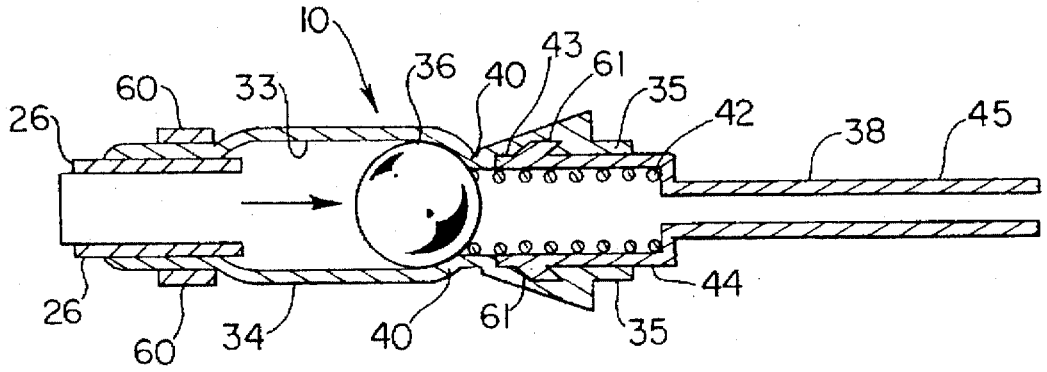
FIG. 3*a* is a sectional view of the device taken along lines 3—3 of FIG. 1 with the arrows indicating fluid flow, the obturator to a first position, blocking the expansible tubing.
Figure 3B:
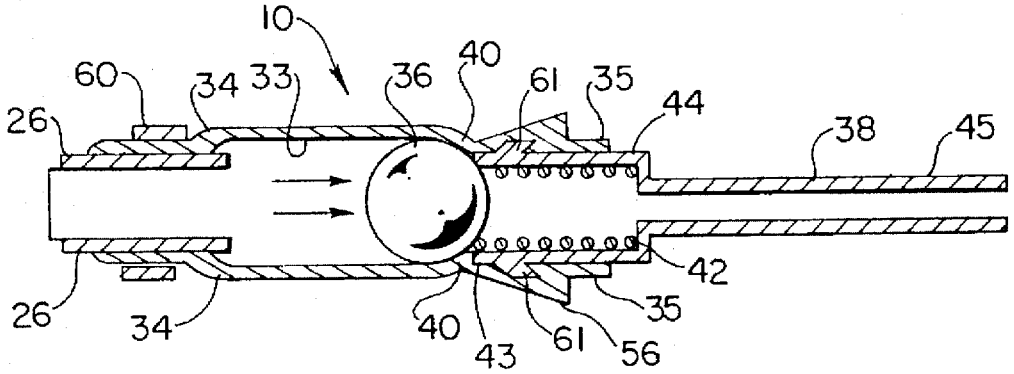
FIG. 3*b* is a sectional view of the device taken along lines 3—3 of FIG. 1 where the fluid flow is pushing the obturator to a second position, blocking both the expansible tubing and the outlet housing and compressing the spring.
Figure 3B:
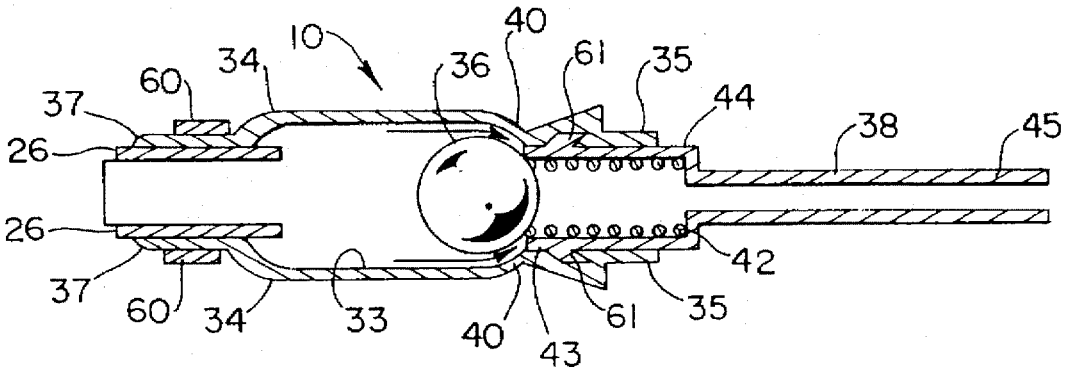
Figure 3C:
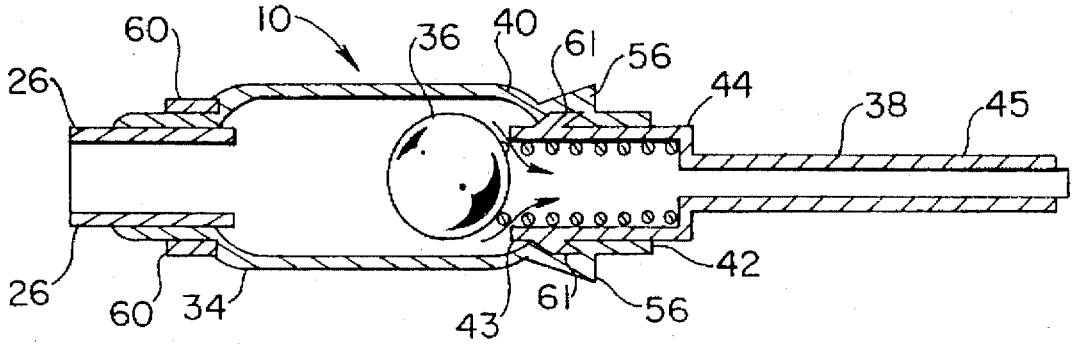
FIG. 3*c* is a sectional view taken along lines 3—3 of FIG. 1, illustrating the obturator in a third position, unblocking both the expansible tubing and the outlet housing.

Illustrated at FIG. 3*a*, the obturator 36 is shown in a first position with compression spring 42 expanded. A fluid seal is formed between expansible tubing 34 and obturator 36 restricting fluid flow through nozzle 38. As fluid flows into expansible tubing 34, FIG. 3*b*, the fluid pressure in expansible tubing 34 increases, and obturator 36 is urged forward in expansible tubing forming a seal between obturator 36 and first end of housing 43 and compressing compression spring 42. Compression spring 42 is shown in FIG. 3*b* fully compressed. As additional fluid flows into expansible tubing 34 in response to activation of actuation button 28, further expansion of expansible tubing 34 results in fluid bypassing obturator 36, FIG. 3*b'*, breaking the fluid seal between obturator 36 and expansible tubing 34. However, a seal remains between obturator 36 and first end of housing 43. Fluid pressure, shown by arrows in the figures, in front of obturator 36 equilibrates with fluid pressure behind obturator 36 resulting in reduction in the net forward force exerted on the obturator 36. Once the magnitude of this forward force drops below the force exerted on the obturator 36 by compression spring 42, obturator 36 is pushed to a third position, FIG. 3*c*, breaking the seal formed between obturator 36 and first end of housing 43, and fluid is jetted out through nozzle 38. As fluid escapes through nozzle fluid pressure within expansible tubing 34 decreases and expansible tubing 34 contracts and a new seal is formed around obturator and obturator 36 is returned to its first position, FIG. 3*a*. This cycle repeats so long as pressurized fluid enters into pulsator 10.

As is described above, two forces act on obturator 36; namely, fluid pressure and compression spring 42. When the fluid has not bypassed the obturator, 36, the fluid exerts a force on obturator 36 in the forward direction while the spring exerts a force in the reverse direction. The force exerted on obturator 36 by fluid, can be defined mathematically as:

$$Ff=Pf\times\text{effective area}$$

where Ff is the fluid force, Pf is the pressure of the fluid and effective area in this case is the cross sectional area of the obturator 36. Since obturator 36 is a sphere, its cross sectional area is a circle or $\Pi r^2$ (r=radius of the obturator).

The force exerted by compression spring 42 (Fs) on obturator 36 in the reverse direction is:

$$Fs=K\times D$$

where K is the compression spring constant and D is the distance the spring is compressed.

The net force (Fn) exerted on the ball in the forward direction is:

$$Fn=Ff-Fs=(Pf\times\Pi r^2)-K\times D$$

As long as Ff is larger than Fs, the obturator 36 is pushed forward and seal is formed between obturator 36 and expansible tubing and as fluid pressure increases, a seal is formed between obturator 36 and first end of housing 43. Once the fluid bypasses obturator 36, the net force exerted on obturator 36 by the fluid in the forward direction drops because the fluid that has encircled or bypassed the obturator exerts a pressure on obturator 36 in the reverse direction and cancels out some of the force exerted by the fluid behind obturator 36 in the forward direction. The net force exerted by the fluid in the forward direction drops to:

$$Ff=Pf\times\text{effective area}_o$$

where effective $\text{area}_o$ is now equal to cross sectional area of the first end of housing 43. The cross sectional area of the first end of housing 43 is equal to $\Pi r1^2$ where r1 is the inner radius of the first end of housing 43. Therefore, the net force exerted on obturator 36 becomes:

$$Fn=Ff-Fs=(Pf\times\Pi r1^2)-K\times D$$

Since the cross sectional area of the first end of housing 43 is smaller than that of obturator 36, r1 is smaller than r. Ff becomes smaller than Fs, and Fn becomes negative resulting in obturator 36 being forced back unblocking first end of housing 43.

Because the fluid force exerted changes rapidly and repeatedly, the fluid flow out nozzle 38 is intermittent. This pulsating fluid flow stream is a main object of the invention. When used in conjunction with a toy, as illustrated in FIGS. 1 & 2, pulsator 10 produces a machine gun-like burst of fluid flow. An additional advantage is that, because it is fluid force pressure, resulting from increasing amount of fluid within expansible tubing 34, that drives the pulsating stream, inversion of the pulsator-containing-toy does not inhibit operation of the pulsator to produce the pulsating stream. A further advantage of the pulsator of the present invention is the simplicity of construction using relatively few parts, none of which require precise machining. An additional advantage is the ease of filling the reservoir In actual use conditions, a plastic squirt bottle, not shown, with a flexible tip end has been used with success, although any method of introducing fluid into a reservoir may be utilized.

Figure 3D:
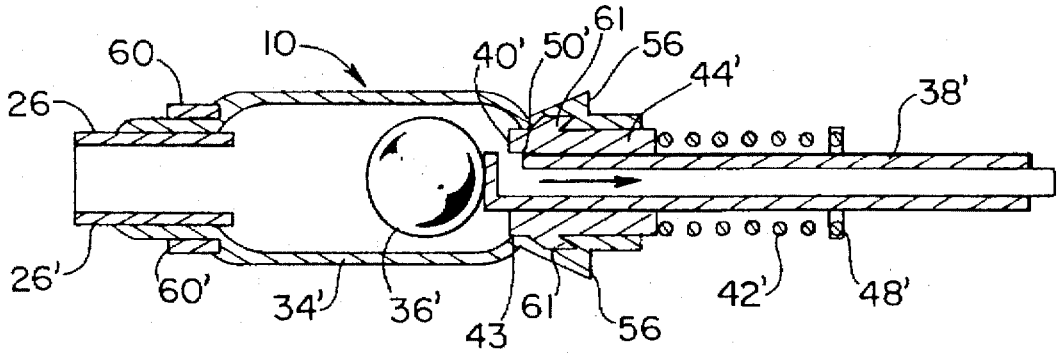
FIG. 3*d* is a sectional view taken along lines 3—3 of FIG. 1, illustrating a second embodiment of the device of this invention with the obturator in a third position unblocking both the expansible tubing and the outlet housing.

In a second embodiment of pulsator 10', the obturator moves between a first, second and third position, similarly to the first embodiment, the third position shown at FIG. 3*d*. The second embodiment 10' provides nozzle 38' having a tension spring mounted outside of nozzle 38'. Nozzle 38' moves within housing 44' in response to obturator 36' moving between first, second and third positions. Increased fluid flow pressure within expansible tubing 34' biases obturator 36' to a second position forming a seal between obturator 36' and a first end of outlet 40'. Biasing obturator 36' to a second position extending tension spring 42'. Once the fluid pressure within expansible tubing 34' reaches a predetermined level and fluid bypasses obturator 36', lowering the net forward force, tension spring 43' contracts and biases obturator 36' to a third position unblocking first end of outlet 40' permitting fluid to flow out pulsator 10' through nozzle Pulsator 10, shown in a position of use in a toy, at FIGS. 1 & 2, consists of loading port 14, reservoir 24 for receiving and storing the fluid, fluid inlet 14 for providing fluid flow communication between expansible elastomeric tubing. In actual use conditions, natural rubber or latex tubing has been used although other materials having the needed properties of flexibility and elasticity could be used. Fluid enters pulsator 10 from reservoir 24 by connecting conduit 26. Actuation of pulsator 10 by manually depressing button 28 releases pressure valve 30 by compressing spring 32 there associated allowing fluid to flow from reservoir 24 into pulsator 10 through connecting conduit 26 into expansible tubing 34. Within expansible tubing 34 is obturator 36 which, in a first position, shown at FIG. 3*a*, blocks passage of fluid from expansible tubing 34 to nozzle 38. Fluid flow, indicated by arrows in FIGS. 3*a*–3*d*, pushes obturator 3*e* against valve seat blocking fluid flow from escaping through nozzle 38. Spring 42 is retained within housing 44.

The fluid pulsator 10 of this application works even when inverted because as long as a necessary volume is maintained in the reservoir 24, fluid fills the expansible tubing 34, the result being that the toy will fire from any position. The fluid pulsator 10 of this application works on water pressure created by addition of fluid, and not by air pressure, as some previous designs have shown.

FIG. 3*d* illustrates a second embodiment of the pulsator 10' which operates in every way similarly to the first embodiment except that tension spring 42' surrounds nozzle 38' to add stability to the nozzle 38'. Tension spring 42' abuts housing 44' and a first end thereof is retained in position by housing 44'. Additionally, apertures 50' are formed into the sides of nozzle allowing fluid to enter nozzle 38' when the obturator 36' is moved to its third position, similarly to that illustrated at FIG. 3*c*, by expansion of expansible tubing 34' in response to increased fluid pressure. Increased fluid pressure is achieved by forcing fluid within reservoir 24, similarly to that illustrated at FIGS. 1 and 2 for the first embodiment, into the expansible tubing 34' by manually actuating the actuation button 28. As a result, more fluid enters expansible tubing 34' expanding such tubing resulting in fluid flowing around obturator 36' positioned therein. When fluid travels cut nozzle 38' it decreases the fluid pressure within expansible tubing 34' allowing obturator 36' to return to its first position, forming a seal between obturator 36' and expansible tubing 34', blocking the fluid passage through the nozzle This temporary blockage and unblocking of nozzle 38' provides the pulsating action to the fluid stream leaving the nozzle 38'.

In the second embodiment, spring 42' is retained in place by anchor 48' at a point where spring 42' abuts nozzle. In this embodiment, nozzle 38' moves in and out of housing 44', recoiling after each "firing" of the toy gun.

In both embodiments, loading port 14 is connected to a pressurized fluid source such as a water faucet, garden hose, squirt bottle or other sources of fluid, with a nozzle adapted to fit into loading port 14. Pressurized fluid flows through the check valve 18, which prevents back-flow of fluid out the loading port 14, into reservoir 24, of natural rubber tubing or other expansible materials. Reservoir 24 expands and stores the fluid under pressure. Reservoir 24 is protected from over-filling by safety valve 46, shown at FIG. 2. To shoot the water gun, pressure valve 30 is opened by pressing button 28. With pressure valve 30 open, fluid flows into connecting tubing 26 and through pressure valve 30 into expansible tubing 34,34' as reservoir 24 retracts.

The second embodiment of pulsator 10' follows the sequence of the first embodiment illustrated in FIGS. 3*a*, 3*b*, 3*b'*, then 3*d* rather than 3*c* of the first embodiment; namely, obturator 36' in a normal first position, FIG. 3*a*, blocking fluid flow by obturator 36' forming a seal with expansible tubing 34'; obturator 36' is urged, in response to additional fluid entering expansible tubing 34', to a second blocking position FIG. 3*b*, blocking both expansible tubing 34' and first end of housing 40' forming a seal with both, urging nozzle 38' to a position blocking fluid outlet and expanding tension spring 42'; obturator 36', in response to additional fluid entering expansible tubing 34', is then urged to an interim position blocking only first end of housing 40'; then obturator 36', in response to additional fluid flow into expansible tubing 34', expanding such tubing around obturator 36' reducing the generally forward pressure forcing obturator 36' against first end of outlet tubing 40' allowing obturator 36' to be biased by nozzle 38' in response to contraction of tension spring 42', to an unblocking third position, FIG. 3*d*. The water or other fluid is ejected out through nozzle 38', lowering fluid pressure allowing expansible tubing 34' to contract and obturator 36' to return to a normal first position. Contraction of expansible tubing 34' around obturator 36' re-establishes a water seal between obturator 36' and expansible tubing 34' and the cycle is repeated.

Method of Assembly of Pulsator

Housing 44 with attached nozzle 38, of one piece construction, receives spring 42. First end of expansible tubing 35 is manually fitted over housing 44 and is retained in position by barbs 61. Obturator 36 is received by a second end of expansible tubing 37 and retained within expansible tubing Second end of expansible tubing 37 is received by and manually fitted over connecting conduit 26. First end of expansible tubing 43 is retained on connecting conduit 26 by means of fastener such as a clamp or ring.

Although the present invention has been described in considerable detail with reference to certain preferred versions thereof, other versions are possible for example a disc-shaped obturator rather than a sphere-shaped obturator could be used. Also, a balloon-type reservoir, having only one opening, could be used. Therefore, the spirit and scope of the appended claims should not be limited to the description of the preferred versions contained herein.

What is claimed is:

1. A fluid pulsator apparatus having a fluid inlet and outlet for converting a continuous stream of fluid into a pulsating stream, comprising:

a) a length of expansible elastomeric tubing, a first end for receiving fluid, said length of expansible elastomeric tubing expanding in response to increased internal fluid pressure created by inlet of the continuous stream of fluid, a second end of said length of expansible elastomeric tubing for outlet of fluid;

b) an obturator, retained internally of said length of expansible elastomeric tubing, for releasably blocking said pulsator outlet;

c) biasing means for momentarily biasing said obturator, from a position blocking said expansible tubing to a position unblocking said expansible tubing;

d) means for repeating biasing of said obturator from a blocking position blocking said pulsator outlet to an unblocking position and back to a blocking position resulting in a rapid pulsating firing of said fluid pulsator through said pulsator outlet; and e) means for providing a continuous stream of fluid into said expansible tubing.

2. The apparatus of claim 1, wherein said biasing means further comprises a means for expanding said expansible elastomeric tubing around said obturator resulting in a decrease of relatively forward fluid pressure within said expansible tubing.

3. The apparatus of claim 2, wherein said biasing means further comprises a compression spring for biasing said obturator to an unblocking position when the relatively forward fluid pressure on said obturator within said expansible tubing decreases.

4. The pulsator of claim 3, wherein means for providing a continuous stream of fluid into said expansible tubing further comprises a generally elongated refillable reservoir in communication with said fluid inlet.

5. The pulsator of claim 4, further comprising a nozzle, mounted on and in fluid communication with second end of length of expansible elastomeric tubing, for imparting directional fluid flow.

6. The pulsator of claim 5, wherein said obturator is sphere-shaped.

7. The apparatus of claim 6, wherein said biasing means further comprises a tension spring for biasing said obturator to an unblocking position when the relatively forward fluid pressure on said obturator within said expansible tubing decreases.

8. A fluid pulsator, for introducing a pulsating pattern into a steady fluid flow stream, comprising:

a) fluid inlet means;

b) a reservoir, in fluid flow communication with said inlet means;

c) expansible tubing in fluid flow communication with said reservoir;

d) a sphere-shaped obturator, retained within said expansible chamber, for temporarily restricting fluid flow through said expansible chamber;

e) a nozzle, in fluid flow communication with said expansible chamber, for imparting direction fluid flow into fluid flow outlet;

f) biasing means for moving said sphere-shaped obturator from a blocking position, restricting fluid flow between said expansible tubing and said nozzle, to an unblocking position, permitting fluid flow between said expansible tubing and said nozzle; and g) means for actuating said pulsator for introducing a pulsating pattern into a steady fluid flow stream.

9. The pulsator of claim 8, wherein said biasing means moving said sphere-shaped obturator between a blocking position and an unblocking position further comprise spring biasing means.

10. The pulsator of claim 9, wherein said biasing means moving said sphere-shaped obturator between a blocking position and an unblocking position further comprise expanding said expansible tubing, in response to continued fluid flow into said tubing, permitting backflow of fluid pressure on said sphere-shaped obturator permitting said spring biasing means to bias sphere-shaped obturator to an unblocking position.

11. The pulsator of claim 10, further comprising means for returning said sphere-shaped obturator to a blocking position and repeating cycle for imparting a pulsating fluid flow to the steady fluid flow stream.

12. A toy having a fluid pulsator for imparting a fluid flow pulsating pattern into a steady fluid flow stream, comprising:

a) fluid inlet means;

b) a reservoir, in fluid flow communication with said inlet means;

c) expansible tubing in fluid flow communication with said reservoir;

d) an obturator, retained within said expansible tubing, for temporarily restricting fluid flow through said expansible tubing;

e) a nozzle, in fluid flow communication with said expansible tubing, for imparting direction fluid flow into fluid flow outlet;

f) biasing means moving said obturator from a blocking position, restricting fluid flow between said expansible tubing and said nozzle, to an unblocking position, permitting fluid flow between said expansible tubing and said nozzle; and g) actuation means actuating said pulsator for introducing a pulsating pattern into a steady fluid flow stream.

13. The toy of claim 12, wherein said biasing means, moving said obturator from a blocking position to an unblocking position, further comprise spring biasing means mounted adjoining said expansible tubing, for biasing said obturator into an unblocking position.

14. The toy of claim 13, wherein said biasing means, moving said obturator between a blocking position and an unblocking position, further comprise a build-up of pressure within said expansible tubing expanding said expansible tubing, permitting fluid pressure to bias said obturator into an unblocking position and further permitting spring biasing means to bias said obturator into an unblocking position, permitting fluid flow through said nozzle.

15. The pressurized water toy of claim 14, wherein said nozzle further comprises at least one aperture formed in a first end thereof for fluid flow therethrough.

16. The pressurized water toy of claim 15, wherein said obturator further comprises a sphere-shaped obturator.

17. A method of providing a pulsating fluid stream, comprising the steps of:

a) providing a continuous pressurized fluid stream;

b) providing a length of expansible elastomeric tubing having and inlet and outlet;

c) temporarily blocking fluid flow through said expansible tubing by providing an obturator, mountable within the length of expansible tubing;

d) temporarily unblocking fluid flow through said expansible tubing by providing actuation means for temporarily actuating said obturator to unblock fluid flow through said expansible tubing; and e) biasing said obturator from a blocking to an unblocking position resulting in pulsating flow of fluid through outlet of said expansible tubing.

18. The method of claim 17, further comprising controlling directional flow of pulsating fluid flow leaving said expansible tubing by providing a nozzle.

19. The method of claim 18, further comprising providing spring biasing means for biasing said obturator from a position blocking fluid flow through said expansible tubing to an unblocking position permitting fluid flow through said expansible tubing.

20. The method of claim 19, wherein said temporarily blocking fluid flow through said expansible tubing by providing an obturator further comprises providing a sphere-shaped obturator.

* * * * *